United States Patent [19]

Cross

[11] 4,263,733

[45] Apr. 28, 1981

[54] DISPLAY MOUNT WITH PROTECTED THERMOMETER

[76] Inventor: Carroll N. Cross, Rte. 2, Box 741, Maitland, Fla. 32751

[21] Appl. No.: 27,942

[22] Filed: Apr. 6, 1979

[51] Int. Cl.[3] ..... G09D 3/04

[52] U.S. Cl. ..... 40/121; D19/21; 283/2

[58] Field of Search ..... 40/107, 120, 121; 206/306; 73/343 R, 343 B, 343 F, 344, 354; D10/57; 283/2, 3, 4; D19/20, 21, 23

[56] References Cited

U.S. PATENT DOCUMENTS

| | | | |
|---|---|---|---|
| D. 143,512 | 1/1946 | Trollen | D19/21 |
| 1,425,513 | 8/1922 | Donovan | 283/2 |

FOREIGN PATENT DOCUMENTS

| | | | |
|---|---|---|---|
| 11801 | of 1902 | Norway | 40/107 |

*Primary Examiner*—Frank Sever

*Attorney, Agent, or Firm*—Duckworth, Hobby, Allen, Dyer & Pettis

[57] ABSTRACT

A display mount for calendars and the like having a glass tube thermometer attached thereon with inherent protection from breakage of the glass tube. The thermometer element is attached to the face of the mount and a thick pad, such as a calendar is affixed to the mount face with a straight edge of the pad aligned essentially parallel to and immediately adjacent the glass tube of the thermometer. In one implementation, the mount includes a carboard back panel and a cardboard face panel with a well formed by a window cutout therein. The thermometer is attached to the back panel in the well with the glass tube aligned with one window cutout edge. The pad is affixed adjacent that edge and the glass tube. Protection against breakage when mailing or shipping the display mount is thus provided without additional carboard or other protective material, resulting in lower manufacturing and mailing costs.

8 Claims, 10 Drawing Figures

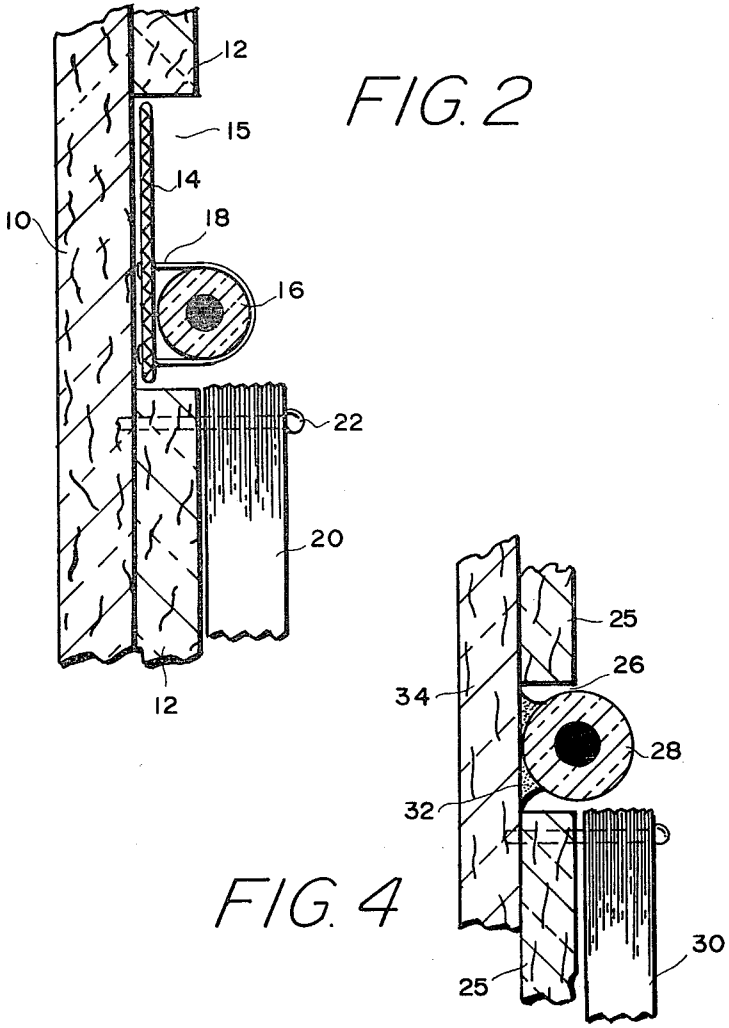
FIG. 2
FIG. 4
10
12
14
15
16
18
20
22
25
26
28
30
32
34
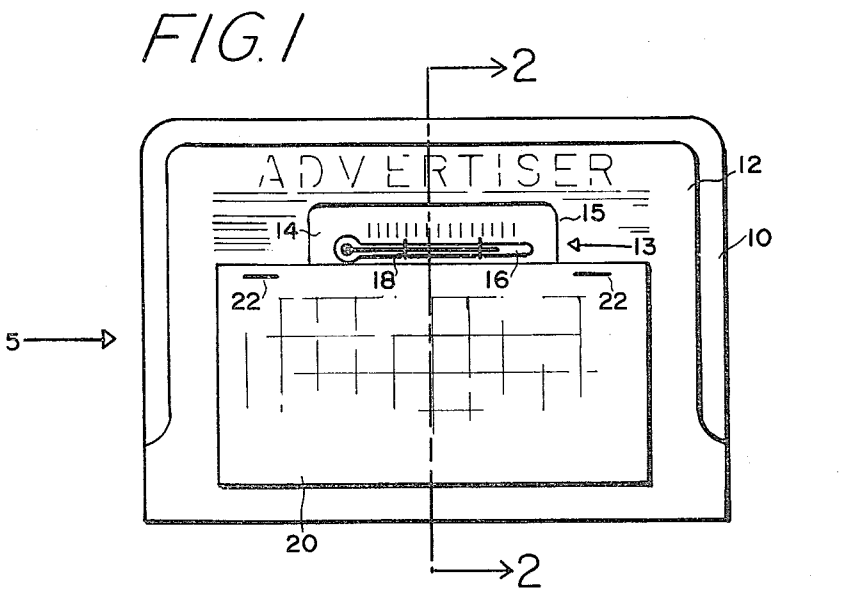
FIG. 1
ADVERTISER
2
2
5
10
12
13
14
15
16
18
20
22
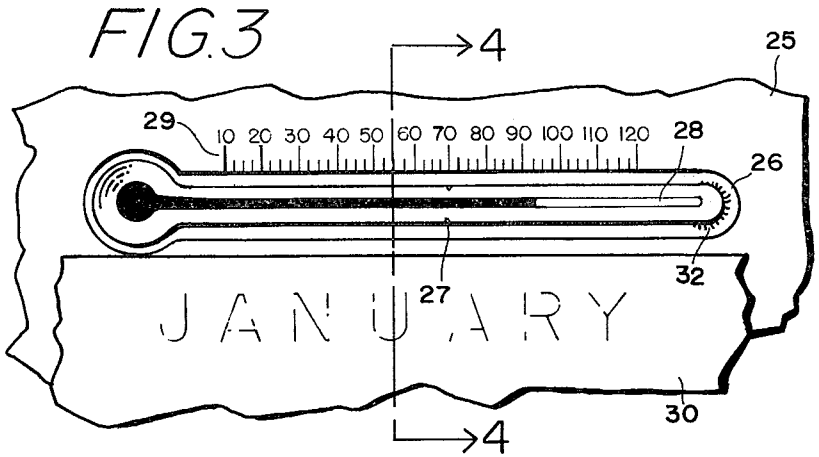
FIG. 3
JANUARY
4
4
25
26
27
28
29
30
32
10 20 30 40 50 60 70 80 90 100 110 120

DISPLAY MOUNT WITH PROTECTED THERMOMETER

BACKGROUND OF THE INVENTION

1. Field of the Invention

The present invention relates to display mounts and in particular to a calendar display mount and method of fabrication thereof having a thermometer attached thereto which is protected by the design and construction from breakage during mailing.

2. Description of the Prior Art

In the past, mounts for the display of calendars or other inserts have generally been made of a plurality of superimposed boards. Generally, sufficient thicknesses of boards is provided for a reasonably stiff mounting surface and to provide easel-type structures therein for standing. Such mounts are desirably constructed to fold flat to permit easy insertion into envelopes for mailing and to minimize cost of postage. One type of mount that is desirable and attractive to advertisers may utilize a calendar in conjunction with a simple thermometer for reading room temperature. The thermometer elements constructed of glass are easily broken, especially when the mount is mailed to a user.

In the prior art mounts, it has been found necessary to use additional thicknesses of cardboard having wells or openings cut therein to surround the glass thermometer element for protection from breakage during mailing, or additional cardboard added for mailing. Such mounts which combine a glass tube mounted thermometer and a calendar with several plies of thick ornamented cardboard to avoid the danger of breakage, particularly when mailed, require excessive cost in both material and postage.

In addition, prior thermometer and calendar combinations have had the calibrated thermometer scales printed on cards a measurable distance from the calendar pad. Some also print the degree indicia on both sides of the thermometer tube. In such prior art designs, the glass tube has not been protected by the calendar pad and has required a substantial recessed depth in the cardboard mount to obtain protection against breakage. While deep wells and extra cardboard are effective, it is seen that these techniques add significantly to the cost of production of the mount as well as the cost of postage for mailing. With continual increases in postal rates, the attractiveness for advertising give-aways of this type of display mount becomes much less. Thus, a need exists for a simple, light-weight calendar or display mount having a glass thermometer element attached thereto but which requires no additional cardboard for protection during mailing.

SUMMARY OF THE INVENTION

A display mount and method of making a display mount are provided in which a simple thermometer element may be attached to the mount without requiring additional cardboard over that used for a non-thermometer mount to provide a reinforcement for mailing. A basic two-ply panel is utilized, with the face panel having an appropriate window cut therein, for acceptance of the thermometer element and temperature scale with the cutout forming a well having a depth equal only to the thickness of the face panel. When a horizontally mounted thermometer is desired, the thermometer cutout window may be placed near the top portion of the mount. Immediately below and adjacent the lower window edge of the mount face, a calendar pad or the like is attached thereto. The thickness of the calendar pad and the depth of the cutout window are selected such that the glass thermometer stem and bulb are about level with or below the surface of the first page of the calendar pad, with the stem substantially parallel to the top of the pad and closely aligned therewith.

As may now be seen, the calendar pad acts to protect the thermometer element during mailing along with the protection provided by the cardboard of the mount. This protection is thus provided at no additional cost of material or labor over that required for a non-thermometer calendar. Although pages of the calendar will be removed during the year, this occurs after delivery of the mount when protection is no longer required.

The novel, self-protecting feature provided by a calendar pad attached immediately adjacent the glass thermometer element is made feasible by the manner of disposition of the thermometer scale. Unlike the usual thermometer, the printed scale is entirely along one side of the glass thermometer tube. This provision allows the opposite side of the glass tube to be disposed against one edge of a thick calendar pad or the like to provide the protection described above. Where the degree indicia are printed on separate cardboard or light metal panels, such as for a preassembled thermometer, the elimination of indica on one side of the thermometer element gives a small additional saving in weight and cost. The manner of mounting of the thermometer immediately above the calendar pad allows printing of advertising copy just above the thermometer, thereby adding greater impact and directing a viewer's attention to the sales message. Other variations of this novel method and mount are possible such as having two pads with adjacent space therebetween for the thermometer, a vertical thermometer adjacent a vertical edge of the pad, and a face panel having the thermometer scale printed directly thereon with a window cut to conform with the shape of the glass thermometer element.

Thus, it is the principal object of the invention to provide an improved mount for calendars and the like having a thermometer element disposed thereon and protected from breakage during mailing.

It is another object of the invention to provide a mount having inherent protection of a glass tube thermometer element attached thereto without necessity of additional reinforcement, cardboard or the like.

It is yet another object of the invention to provide a mount for calendars and the like having a glass tube thermometer element mounted thereon that can be mailed flat with costs for the mount no greater than for a non-thermometer type mount.

It is still another object of the invention to provide a mount for calendars and the like having a glass tube thermometer with temperature indicia along only one side thereof to permit mounting of a calendar pad immediately adjacent the opposite side and to minimize the cost and weight of the thermometer.

It is a further object of the invention to provide a mount utilizing a calendar pad or the like to protect a glass thermometer from breakage.

These and other objects, features and advantages of the present invention will be apparent from the written description and the attached drawings.

BRIEF DESCRIPTION OF THE DRAWINGS

FIG. 1 is a face view of a mount in accordance with the invention;

FIG. 2 is a cross sectional partial view of the mount of FIG. 1 through section 2—2 showing the manner in which the calendar pad is disposed to protect the thermometer element;

FIG. 3 is a face view of an alternative thermometer mount;

FIG. 4 is a cross sectional view of the mount of FIG. 3 through section 4—4;

DESCRIPTION OF THE PREFERRED EMBODIMENT

Figure 6:
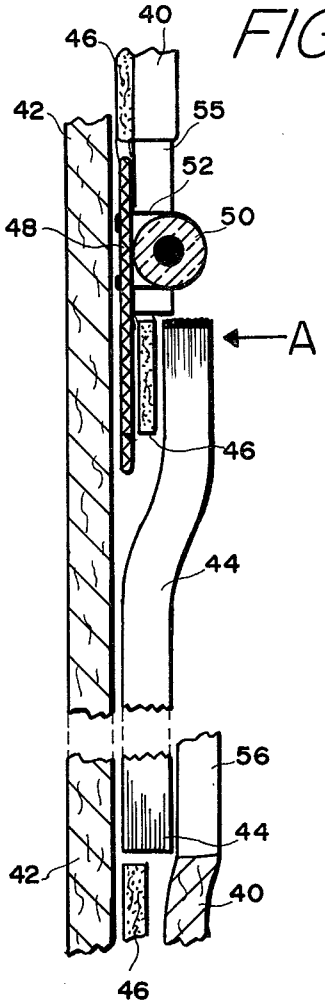
FIG. 6 is a cross sectional view of the mount of FIG. 5 through section 6—6.

Referring to the drawings and first to FIG. 1, a front or face view of my improved display mount 5 is shown. Although many physical shapes, sizes and designs may be applicable, I show here a simple, yet typical, type of mount to which my invention is well suited. In this example, a rectangular calendar pad or the like 20 is mounted horizontally along the lower portion of the mount with a thermometer assembly 13 mounted thereabove. As best seen in the cross-sectional view of FIG. 2, the mount consists of a back cardboard panel 10 and a face cardboard panel 12 with the two panels joined by glueing or other such means. As is common, face panel 12 may be die cut in an attractive design. A window space 15, which may be a long narrow substantially rectangular opening, is die cut in face panel 12. This window 15 thus forms a shallow well in front of back panel 10. A thermometer scale 14 of assembly 13, having a typical thermometer element 16 stapled or otherwise attached thereto, is inserted in well 15 on the front surface of back panel 10 in well 15 with the lower edge of glass tube 16 immediately adjacent to and below the level of the upper edge of pad 20. As may be noted from FIG. 1 and FIG. 2, thermometer element 16 is disposed close to the lower edge of window 15. Calendar pad 20, which may be 12 to 24 or more pages, is selected to have a thickness equal to or greater than the distance that thermometer element 16 projects above face panel 12. Pad 20 may be fastened to panel 12 by staples 22, or otherwise affixed, so that its upper edge is immediately adjacent to and substantially parallel with thermometer element 16. Thus, the upper edge of pad 20 acts to guard the glass stem and bulb of thermometer element 16 from normal breakage when the mount 5 is inserted in an envelope for subsequent mailing.

Advantageously, the breakage protection provided by pad 20, which is normally required for the display mount, does not represent an extra cost element nor does it require extra assembly labor. More importantly, there is no increase in weight of the finished product required to provide protection for thermometer element 16 and therefore mailing costs for both bulk shipment and individual mailing due to the cardboard mount are not increased over those for a non-thermometer mount.

A significant aspect of the thermometer assembly 13 of FIGS. 1 and 2 is the design of thermometer scale 14. Here, the degree indicia are advantageously placed along only one edge of glass tube 16 rather than along both edges as in conventional thermometers. This design permits glass tube 16 to be located close to the upper edge of pad 20 as best seen in FIG. 2. Another advantage of this preferred arrangement is that the advertising message usually present on calendar mounts may be printed immediately above thermometer assembly 13 and therefore comes easily to the conscious or subconscious attention of a person glancing at the temperature.

Turning now to FIG. 3, a partial section of a mount is shown with an alternative method of mounting a thermometer element. Here, the thermometer scale 29 is pre-printed on face panel 25 which has a specially shaped window 26 die cut and aligned with scale 29. The window 26 matches the general shape of the thermometer element 28 with sufficient end space to allow alignment of the element 28. Thermometer elements are furnished with a scratch or nick in the glass stem as at 27 indicative of a particular temperature such as 70° F. As best seen in FIG. 4, which is a cross-section through section 4—4 of FIG. 3, element 28 may be fastened to rear panel 34 by cement 32 after alignment of nick 27 with the appropriate degree mark on scale 29. As previously described in the implementation of FIG. 1, pad 30 is affixed just below element 28 with its top edge aligned therewith, thereby providing the desired protection.

Figure 5:
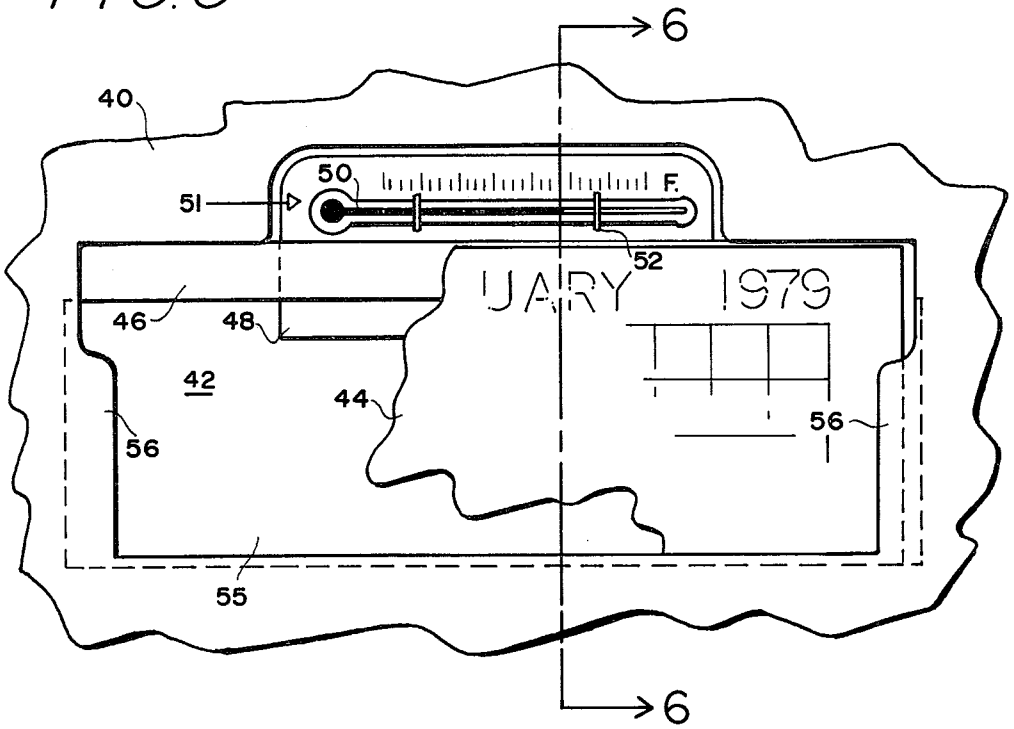
FIG. 5 is a face view of an alternative mounting for the thermometer of FIG. 1.

Another alternative mounting for a prefabricated thermometer assembly 51 is shown in FIGS. 5 and 6. A die cut window 55 is provided in face panel 40 having an upper area for accepting thermometer assembly 51 and a larger lower area for accepting calendar pad 44 or the like. Window 55 includes ears or tabs 56 on either side thereof to hold pad 44 in place. A thin cardboard panel 46 having a cutout matching the thermometer scale and upper part of window 55 is disposed between front panel 25 and rear panel 34 and aligned with window 55. Insert 46 provides two advantages: first, the labor and cost of assembly of the thermometer 51 in the mount is reduced since the worker simply slips the lower edge of scale 48 through the die cut opening under narrow strip of insert 46 and drops the assembly 51 into its well space. The final step is to slip pad 44 into its window space of window 55 behind tabs 56; second, the small additional thickness of panel 46 pushes the top edge of pad 44 slightly outward as shown at A, FIG. 6, providing additional protection to thermometer element 50.

Figure 7:
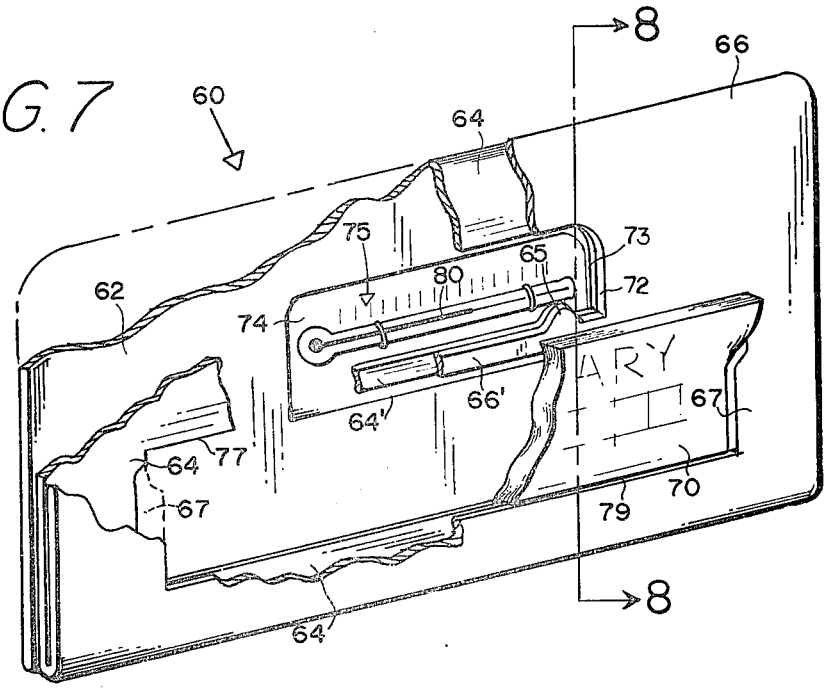
FIG. 7 is a partially cutaway face view of a variation of the mount shown in FIG. 5.
Figure 8:
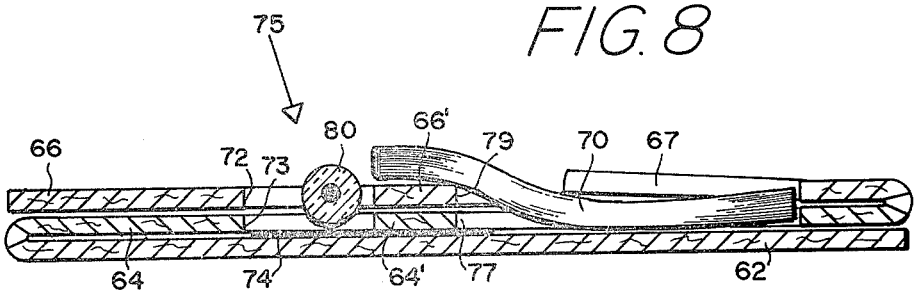
FIG. 8 is a cross sectional view of the mount of FIG. 7.

A display mount 60 using a variation of the mounting for a prefabricated thermometer assembly just described is illustrated in FIG. 7. The mount 60 is fabricated from a single section of cardboard, folded to form three plies, a back panel 62, an intermediate panel 64, and a face panel 66. As seen in FIGS. 7 and 8, the back panel 62 is solid while the intermediate panel 64 and the face panel 66 are die cut as appropriate. Referring to the partial cutaway view of FIG. 7, it may be noted that intermediate panel 64 has a window 73 die cut therein for accepting the thermometer assembly 75. A second larger window 77 just below the thermometer window 73 is die cut for accepting a portion of the calendar pad 70. Similarly, face panel 66 has a die cut window 72 which will coincide with the window 73 of the intermediate panel 64 when the mount is assembled. A window 79 is also provided in the face panel 66 for insertion of the calendar pad 70 and matches the calendar pad window 77 for the intermediate panel 64 along the horizontal top and bottom edges. However, the side cuts have two mounting tabs 67 provided which extend from the bottom horizontal edge of the window 79 upward toward the top edge. The intermediate panel has a strip 64' separating the thermometer window 73 and the pad window 77, and face panel 66 has a matching strip 66'. During assembly, the preassembled thermometer unit 75 is inserted as best seen in FIG. 8 and the panel folds made as shown to hold the lower part of thermometer back plate 74 between strip 64' and back panel 62. Thus, intermediate panel 64 and face panel 66 with strips 64' and 66' form a double-thickness well for thermometer assembly 75 with glass tube thermometer 80. When calendar pad 70 is inserted behind tabs 67 of face panel 66, the upper edge of the pad is forced outward slightly by the thicknesses of strips 64' and 66' as noted in FIG. 8. The lower edge of pad 70 rests on the double thickness of the lower edge of the calendar windows 77, 79. Advantageously, the double thickness of strips 64', 66' plus the thickness of pad 70 provides the desired protection for thermometer tube 80. Due to the method of assembly and the bearing of strips 64' on the calendar assembly back plate 74, no cement or other attaching means are necessary to hold the assembly in place. An additional feature of this embodiment is a small protrusion 65 formed in strips 64' and 66' on the right portion of the lower edge of windows 72, 74. Protrusion 65 projects upward to just touch the lower edge of thermometer bulb 80 assisting to maintain the thermometer element aligned and square with windows 72, 74. It is to be understood that after assembly, the edge of mount 60 may be bound with tape or otherwise secured and a conventional easel or other support means added.

Figure 9:
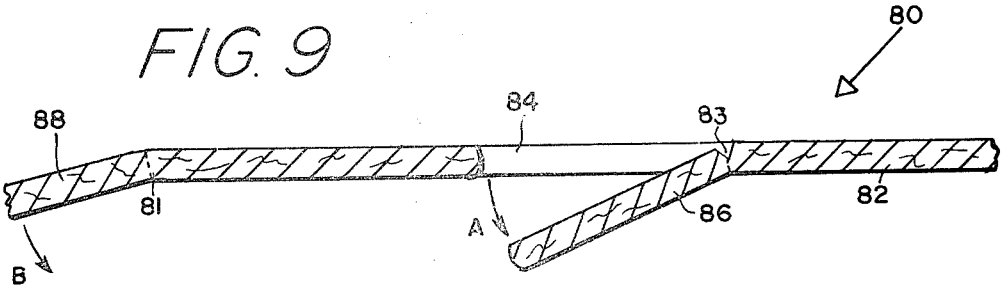
FIG. 9 is a partial cross sectional view of a panel of a mount which utilizes a die cut window flap for protection of a thermometer.
Figure 10:
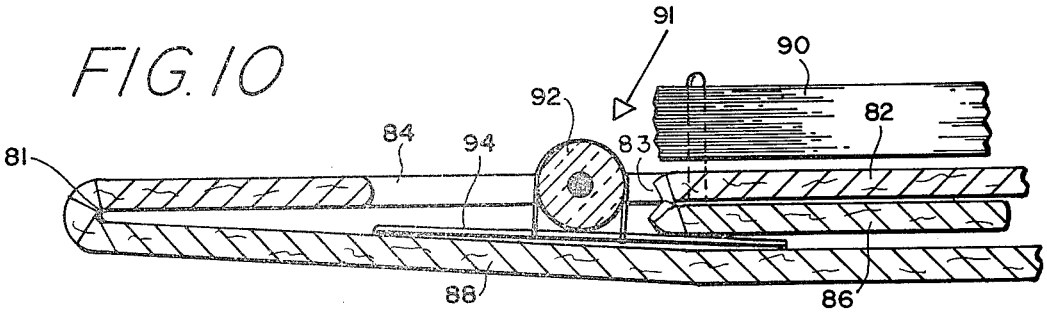
FIG. 10 is a partial cross sectional view of an alternative mounting for a thermometer using the panel of FIG. 9.

Turning now to FIG. 9 and FIG. 10, cross-sectional views of a two-ply display mount as described with reference to FIGS. 1 and 2 is shown which provides protection for a thermometer element equivalent to a three-ply mount with no additional cardboard required. In FIG. 9, the cardboard panel 80 before assembly of the mount is shown having a die cut window 84 in which complete cuts are made only along the top edge and the two side edges, and a scoring cut 83 along the lower edge, thus forming a flap 86. A fold 81 is made at the left (top) side as shown, forming a back panel 88 and a face panel 82. The flap 86 is bent backwards as shown by arrow A and the rear panel 88 is bent back as shown by arrow B. FIG. 10 shows a cross section of the mount 80 in its final assembled condition with thermometer assembly 91 and paper pad 90 attached thereto. As may be noted, flap 86 has been bent back 180° and back panel 88 has also been folded back 180°. Thus, window 84 in concert with back panel 88 and the two thicknesses of flap 86 and face panel 82 form a well for thermometer assembly 91. The back panel 94 of thermometer assembly 91 is slipped between pad 86 and back panel 88, thus holding the assembly in place without requiring cement or other means of fastening. Calendar pad 90 is attached with its upper edge adjacent to thermometer bulb 92 and aligned therewith to provide the desired protection as previously discussed. It is to be understood that the final mount assembly is to be taped or otherwise secured so as to maintain the mount in the form shown in FIG. 10. Conventional easel or support designs may be used.

As may now be clear, I have provided simple configurations for display mounts for calendars and the like having a glass thermometer attached thereto which by use of the normal components of such mounts provides inherent protection of the fragile thermometer element against normal breakage in shipping. Thus, no additional expense for packing and mailing is required over a non-thermometer type display mount. In the exemplary versions disclosed herein, I have shown certain particular designs. However, I am not to be limited to these designs, and many variations and different styles of display mounts may incorporate my invention as will be obvious to those of ordinary skill in this art. For example, the thermometer element may be mounted in a variety of positions on the mount and it is only necessary to have an edge of the pad immediately adjacent to the glass tube to provide protection. Similarly, where more than one yearly pad is attached to the mount, a narrow space may be left between two edges of the pads to provide space for mounting of the thermometer element.

While I have shown the thermometer assembly disposed in a well formed by the front and back panels, the thermometer assembly may be fastened directly to the face panel and a pad having a thickness at least equal to the height of the glass thermometer tube utilized for protection thereof in accordance with the invention. Such modifications and variations are thus considered to fall within the scope and spirit of my invention.

I claim:

1. A display mount comprising in combination:
a mounting panel;
a glass tube thermometer attached to said mounting panel;
a pad of paper having an essentially straight edge length affixed to said mounting panel with said straight edge having spacing immediately adjacent and essentially parallel to said glass tube thermometer, said pad having a substantial thickness; said length, spacing and thickness being dimensioned to substantially eliminate breakage of said thermometer during mailing or shipping thereof.

2. The display mount as defined in claim 1 in which said front panel has a temperature scale printed thereon.

3. The display mount as defined in claim 2 in which said thermometer is attached to said mount by cement.

4. The display mount as defined in claim 1 in which said pad is a calendar pad.

5. A display mount comprising in combination:
a back panel;
a front panel having a cutout window, said front panel affixed to said back panel;
a glass tube thermometer disposed within said window in which portions thereof project above the face of said front panel; and
a pad of paper having an essentially straight edge length affixed to said front panel with said straight edge having spacing immediately adjacent and essentially parallel to said thermometer, said pad having a thickness projecting a greater distance above said face of said front panel than said projecting portions of said thermometer;
whereby said thermometer is protected by said pad from breakage.

6. The display mount as defined in claim 5 in which said front panel has printed material thereon.

7. The display mount as defined in claim 5 in which said thermometer is a pre-assembled unit having a printed temperature scale panel, a glass stem and bulb thermometer element, and means for affixing said thermometer element to said scale panel.

8. The display mount as defined in claim 7 in said length, spacing and thickness being dimensioned to substantially eliminate breakage of said thermometer during mailing or shipping thereof.

* * * * *